US007665477B1

(12) United States Patent
Hathaway

(10) Patent No.: US 7,665,477 B1
(45) Date of Patent: Feb. 23, 2010

(54) SELF CLOSING STATIONARY UMBRELLA

(76) Inventor: Martin Hathaway, 566 Sand Hill Rd., Gardiner, NY (US) 12525

( * ) Notice: Subject to any disclaimer, the term of this patent is extended or adjusted under 35 U.S.C. 154(b) by 194 days.

(21) Appl. No.: 12/009,781

(22) Filed: Jan. 22, 2008

(51) Int. Cl.
*A45B 25/14* (2006.01)

(52) U.S. Cl. ..... 135/20.3; 135/23; 135/20.1; 135/16

(58) Field of Classification Search ..... 135/98, 135/20.3, 16, 15.1, 21, 29, 31–32, 20.1, 23; 211/197; 116/173; 254/325, 334, 352; 242/395
See application file for complete search history.

(56) References Cited

U.S. PATENT DOCUMENTS

| | | | | | |
|---|---|---|---|---|---|
| 2,183,833 | A | | 12/1939 | Farhar | 135/20 |
| 2,661,752 | A | * | 12/1953 | Kampf et al. | 135/20.3 |
| 3,565,087 | A | * | 2/1971 | Arai et al. | 135/23 |
| 3,643,673 | A | * | 2/1972 | Weber | 135/25.1 |
| 3,680,571 | A | | 8/1972 | Houston | 135/22 |
| 4,319,600 | A | | 3/1982 | Roche | 135/20 M |
| 4,610,262 | A | * | 9/1986 | Broyer et al. | 135/23 |
| 5,564,453 | A | * | 10/1996 | Steiner | 135/98 |
| 5,711,333 | A | * | 1/1998 | Vanderminden, Sr. | 135/20.3 |
| 6,330,886 | B1 | | 12/2001 | Culver | 135/15.1 |
| 6,446,650 | B1 | * | 9/2002 | Ma | 135/20.3 |
| 6,575,182 | B2 | * | 6/2003 | Tung | 135/20.1 |
| 6,722,381 | B2 | * | 4/2004 | Lai | 135/20.3 |
| 6,732,753 | B2 | * | 5/2004 | Chang | 135/20.3 |
| 6,871,659 | B2 | * | 3/2005 | Tung | 135/20.3 |
| 7,328,715 | B2 | * | 2/2008 | Neubardt | 135/40 |
| 2003/0131875 | A1 | * | 7/2003 | Wu | 135/20.3 |

* cited by examiner

*Primary Examiner*—Winnie Yip
(74) *Attorney, Agent, or Firm*—Sandra M. Kotin

(57) ABSTRACT

An outdoor umbrella that closes automatically in high wind is disclosed. The wind causes the main support post of the umbrella to flex from the vertical dislodging a plunger from its weight bearing mounting on a rigid rod. The plunger is attached to an actuator rod extending upward within the support post. When the plunger is displaced the actuator rod is caused to move downward thereby activating a releasing ratchet which frees a shaft to rotate and the cable which holds the canopy to unwind. A hydraulic cylinder attached to one of the canopy ribs presses on the rib to close the canopy and maintain the canopy in closed orientation. As the canopy closes a reset mechanism is activated which resets the plunger onto the rigid rod. Once closed the canopy will remain closed until raised by manually rewinding the cable onto the shaft using a hand crank attached to the end of the shaft. A second ratchet assembly incorporated into the hand crank prevents the hand crank from spinning when the umbrella closes.

19 Claims, 7 Drawing Sheets

SELF CLOSING STATIONARY UMBRELLA

FIELD OF THE INVENTION

The instant invention relates to a stationary outdoor umbrella that closes automatically when subject to high winds.

BACKGROUND OF THE INVENTION

Outdoor umbrellas have been in use for many years but they must be opened and closed manually. When an umbrella is left open and the weather changes abruptly, often there is no time to close the umbrella or the owner is not available to do so. If there are high winds the umbrella canopy can sustain damage or the entire umbrella can be lifted from its anchor and travel some distance, causing damage to anything on which it may land. Additionally, the umbrella canopy and support system can be severely damaged when the umbrella falls.

There have been umbrellas developed to prevent wind damage when the umbrella is left open. Culver, in U.S. Pat. No. 6,330,886, discloses an outdoor umbrella with a canopy composed of a plurality of wedge shaped metal vanes or panels. The vanes are arranged such that one edge of each vane overlaps the next adjacent vane. A portion of each vane may lift free of the adjacent vane in a wind, thus the canopy is vented and does not rise in the wind. This umbrella can be closed manually.

In U.S. Pat. No. 4,319,600, Roche teaches an outdoor umbrella assembly designed to prevent the umbrella from lifting off its mounting when subjected to gusts of wind. The canopy of the umbrella is supported by a series of braces connected to' a slidable hub located on the main support post. Within the main support post is a movable auxiliary post surrounded by a spring. The auxiliary post is guided to move vertically only. The spring causes the auxiliary post to resist but not prevent upward movement of the auxiliary post relative to the main post when wind acts on the canopy. When the wind lifts the canopy, the spring allows the hub to move downwardly. When the wind stops the hub moves upwardly to its former position. A control rod limits the downward movement of the hub. Thus the canopy essentially flaps up and down in the wind. The canopy can be manually closed with a crank and cable assembly.

Various forms of self-closing umbrellas have been reported. In U.S. Pat. No. 2,183,833 to Farhar teaches a coin operated umbrella that is permanently installed on a beach. A coin starts an electric motor that activates a chain driven pinion gear which raises a rack and the attached umbrella from its cylindrical housing. There is a timer in cooperation with the motor so that when the specified time has elapsed the motor reverses and the umbrella is drawn back into the housing. Electricity is supplied through underground cables.

An outdoor umbrella that can close completely by itself when subjected to strong winds is taught by Houston in U.S. Pat. No. 3,680,571. The umbrella is supported by a hollow support post in two telescoping sections. The upper section moves within the lower section. There is a helical spring mounted within the upper section which urges it upward when the umbrella is folded. The canopy is supported by a series of ribs pivotally connected at their upper ends to the upper section. The lower ends of the ribs are connected to a sleeve that is slidably mounted for limited movement on the lower section. When a high velocity wind lifts the canopy the ribs bow upwardly causing the sleeve to move upwardly as does the upper section until the canopy closes. Suitably positioned detent members are released allowing the spring to expand and the umbrella to close. The umbrella can be opened and closed manually with a conventional crank and cable. The mechanism of this invention relies on the lifting effect of a strong wind on the canopy to actuate the closing mechanism. If there is wind, but not strong enough, the fabric of the canopy can be damaged and the umbrella will not close.

There is a need for a self closing umbrella that does not depend upon the effect of the wind to lift the canopy of the umbrella. There is a need for a self closing umbrella that is sensitive to wind, that closes quickly and that remains closed until manually reopened. There is a need for an umbrella having a self-closing mechanism that is automatically reset when the umbrella closes.

BRIEF SUMMARY OF THE INVENTION

The present invention provides a self closing mechanism for an outdoor umbrella that is activated by the effect of the wind on the support post. Once closed the umbrella will remain closed regardless of the severity of the wind until reopened manually.

It is an object of the present invention to provide a mechanism for a self closing outdoor umbrella that causes the umbrella to close quickly and efficiently under windy conditions.

Another object of the present invention is to provide an umbrella that, once closed, will stay closed no matter how high the winds.

It is another object of the present invention to provide a mechanism that is reset automatically.

A further object of the present invention is to provide a mechanism that does not permit the umbrella to reopen once it starts to close.

Another object of the present invention is to provide an umbrella assembly that is easy to manufacture and that performs well over time.

A still further object of the present invention is to provide an umbrella that will close quickly in windy conditions so that it cannot be lifted from its pedestal which can result in damage to the umbrella, to furniture and to the surroundings.

An object of the present invention is to provide a mechanism to close the umbrella that is dependent upon the effect of the wind on the support post.

A further object of the present invention is to provide a mechanism that permits the umbrella to be manually closed by putting pressure on the support post.

A still further object of the present invention is to provide a ratcheted hand crank so that the crank will not spin when the umbrella is automatically lowered.

In furtherance of the objects of the present invention there is provided an outdoor umbrella that closes automatically when acted upon by high winds which comprises a canopy, a canopy support including a fixed collar and pivotally attached primary ribs in cooperation with secondary ribs each secondary rib being pivotally attached at one end to a primary rib and at the other end to a slidable sleeve disposed beneath the collar, a pulley situated above the slidable sleeve, a rotatable horizontal shaft having a first end and a second end situated below the slidable sleeve, a flexible cable a first end of which is affixed to the horizontal shaft and the second end extending upward over the pulley and being affixed to the slidable sleeve, a crank assembly in cooperation with the second end of the horizontal shaft and a support base for supporting the umbrella on a horizontal surface. The umbrella further comprises a main tubular support post divided into two segments, an upper first segment in communication with a lower second segment, each segment having an upper end, a midpoint, and a lower end, the fixed collar being affixed to the upper end of the first segment, the slidable sleeve receiving the first segment and being slidable thereon, the pulley being mounted within the first segment between the collar and the slidable sleeve, an opening in a wall of the first segment adjacent to the pulley such that the second end of the flexible cable exits the first segment through the opening to reach said slidable sleeve and the horizontal shaft being rotatably mounted at substantially the midpoint of the first segment and extending outward through opposing walls thereof, the two segments enabling the assembly and maintenance of the contained structures. There are also an expansile member for the exertion of constant pressure on a secondary rib to close the canopy in response to the high winds and for preventing the canopy from reopening in the high winds; a first support assembly supporting one end of the horizontal shaft including means for restricting the free rotation of the horizontal shaft until the umbrella is acted upon by the high winds, and a second support assembly supporting the opposing end of the horizontal shaft and permitting smooth rotation of the horizontal shaft when the umbrella closes in response to the high winds, and means for preventing the crank assembly from rotating as the horizontal shaft rotates when the umbrella is acted upon by the high winds. A trigger assembly in communication with the restricting means to release the restricting means when the umbrella is acted upon by the high winds permitting the horizontal shaft to rotate freely and a reset system to automatically reset the trigger assembly as the umbrella closes in response to the high winds are also provided.

The present invention also teaches an outdoor umbrella that closes automatically when acted upon by high winds comprising a canopy, a canopy support including a fixed collar and pivotally attached primary ribs in cooperation with secondary ribs each secondary rib being pivotally attached at one end to a primary rib and at the other end to a slidable sleeve disposed beneath the collar, a pulley situated above the slidable sleeve, a rotatable horizontal shaft having a first end and a second end situated below the slidable sleeve, a flexible cable a first end of which is affixed to the horizontal shaft and the second end extending upward over the pulley and being affixed to the slidable sleeve, a crank assembly in cooperation with the second end of the horizontal shaft and a support base for supporting the umbrella on a horizontal surface. There is also a main tubular support post divided into two segments, an upper first segment in communication with a lower second segment, each segment having an upper end, a midpoint, and a lower end, the fixed collar being affixed to the upper end of the first segment, the slidable sleeve receiving the first segment and being slidable thereon, the pulley being mounted within said first segment between the collar and the slidable sleeve, an opening in a wall of the first segment adjacent to the pulley such that the second end of the flexible cable exits the first segment through the opening to reach said slidable sleeve and the horizontal shaft being rotatably mounted at substantially the midpoint of the first segment and extending outward through opposing walls thereof, the two segments enabling the assembly and maintenance of the contained structures. The umbrella further comprises means for exerting constant pressure on a secondary rib to close the canopy in response to the high winds and for preventing the canopy from reopening in the high winds, a releasable first ratchet assembly to support the first end of the horizontal shaft and restrict the rotation of the horizontal shaft until the umbrella is acted upon by the high winds, a second ratchet assembly to prevent the crank assembly from rotating as the horizontal shaft rotates when the umbrella is acted upon by the high winds, a trigger assembly to actuate the releasable first ratchet assembly, and means for automatically resetting the trigger assembly as the umbrella closes in response to the high winds.

Other features and advantages of the invention will be seen from the following description and drawings.

DETAILED DESCRIPTION OF THE INVENTION

Figure 1:
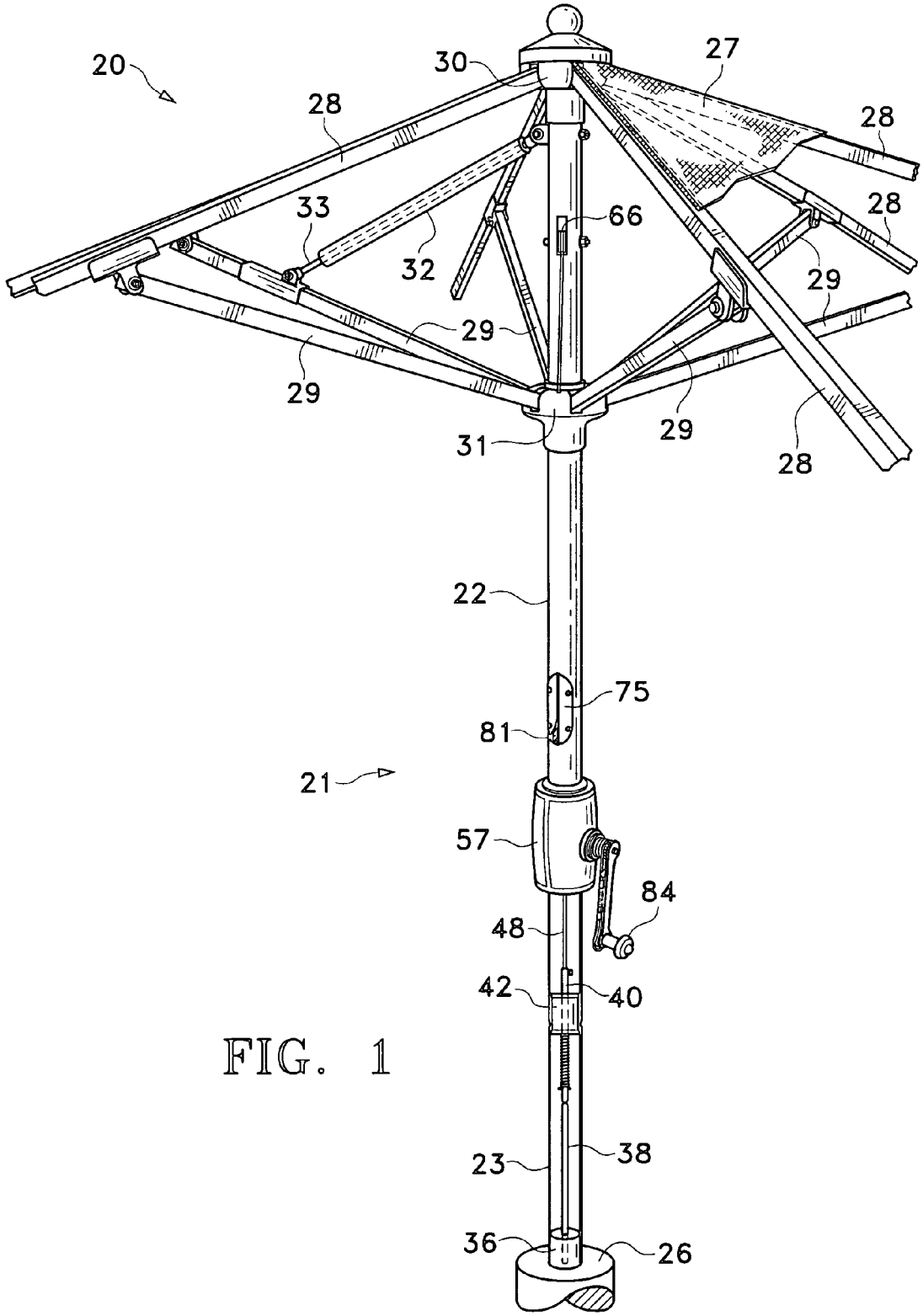
FIG. 1 is a partial cutaway view of the umbrella of the present invention.

The umbrella 20 of the present invention may be represented in FIG. 1. From a first view of the umbrella 20 it may not appear to differ from those known in the prior art. Most of the mechanisms that control the present invention may be internal, i.e., located within the support system.

The umbrella 20 may be supported by a central support post 21 that is formed in two segments, an upper segment 22 and a lower segment 23. The bottom portion 24 of the upper segment 22 may be crimped to allow it to be close fitted into the top of the lower segment 22. The bottom of the lower segment 23 may be supported by any umbrella base 26 known in the art.

The canopy 27 of the umbrella 20 may be of any conventional material and may be supported by a plurality of primary ribs 28 and secondary ribs 29. The upper ends of the primary ribs 28 may be pivotally connected to a collar 30 affixed at the top of the upper segment 22 of the support post 21. The primary ribs 28 may extend outwardly from the upper segment 22 to fully support the canopy 27. One end of each secondary rib 29 may be pivotally attached to substantially the center of a primary rib 28 while the other end of each secondary rib 29 may be pivotally attached to a sleeve 31 slidably disposed about the upper segment 22.

Figure 2:
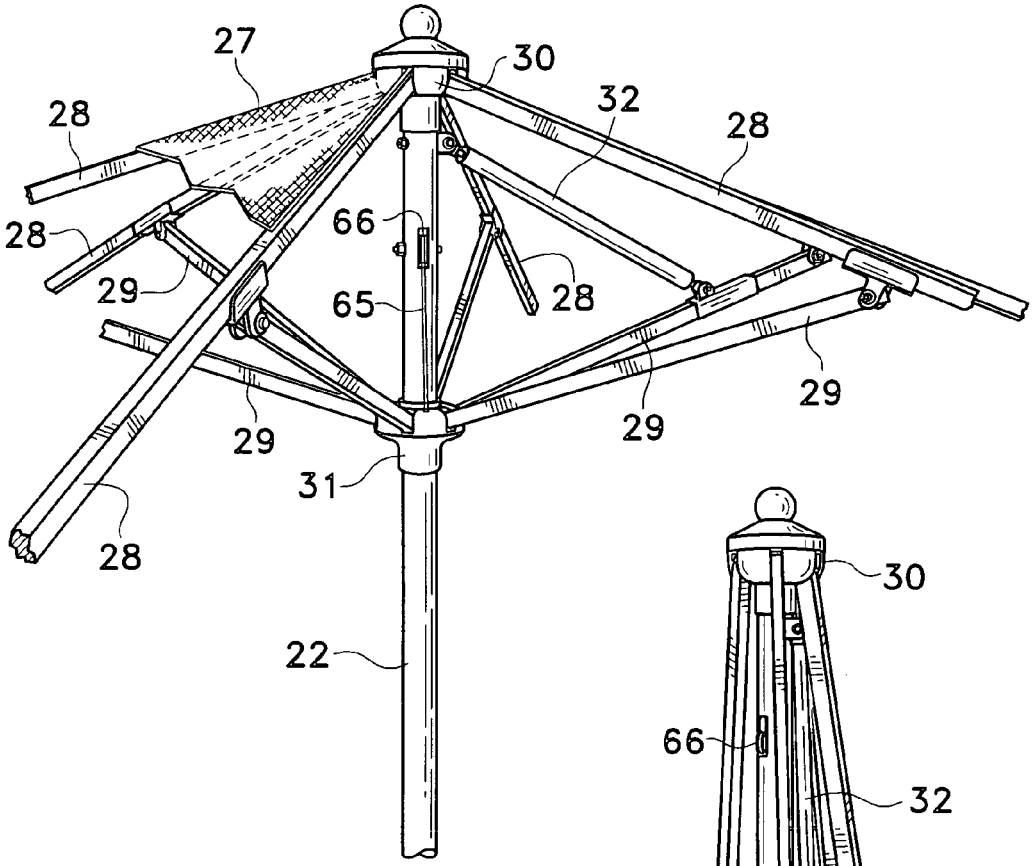
FIG. 2 is close up perspective view of the opened rib assembly.
Figure 3:
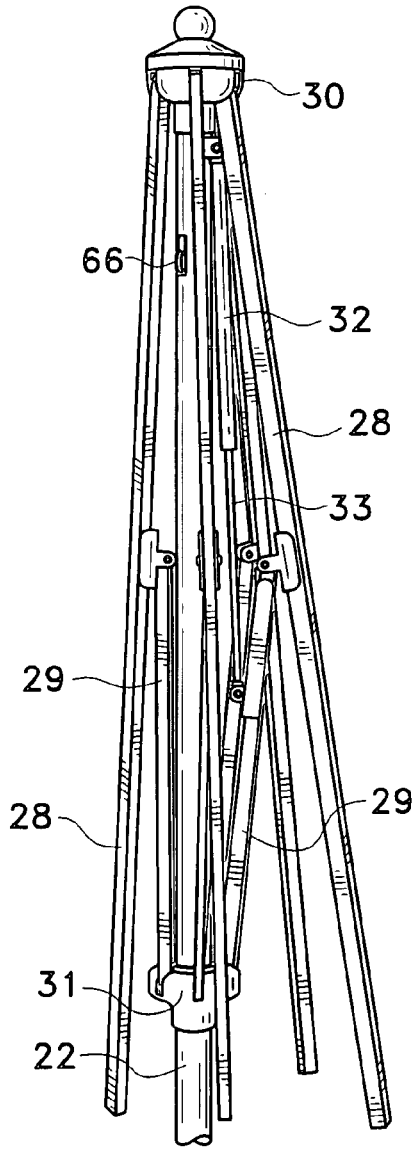
FIG. 3 is a close up perspective of the closed rib assembly.

Means may be provided to close the canopy in response to high winds and to prevent the canopy from reopening in the high winds. Such means may exerts a constant downward force against one of the secondary ribs. A hydraulic cylinder may accomplish this. The end of a loaded hydraulic cylinder 32 may be pivotally attached to the upper segment 22 of the support post 21 at a point below the collar 30 and above the sleeve 31. The outer end of the cylinder's piston 33 may be pivotally attached to one of the secondary ribs 29. These structures may be seen in FIGS. 1, 2 and 3. When wind triggers the closing mechanism (described below) the restraint holding the rib system in raised orientation may be released. The force within the hydraulic cylinder 32 may push the piston 33 outward and downward, forcing the rib system to pivot downwardly until the ribs 28 and 29 may be substantially parallel with the main support post 21 and the piston 33 may be fully extended. The sustained downward pressure of the piston 33 may maintain the rib system and with it the canopy 27 in closed orientation regardless of the force of the wind or any other external forces until manually raised. As the ribs 28 and 29 pivot downwardly; the sleeve 31 may also be caused to move downward along the upper segment 22 of the support post 21.

The triggering or actuating mechanism that sets in motion the closing of the umbrella 20 may be found within the lower segment 23 of the support post 21. There may be an anchoring bushing 36 disposed in the bottom of the lower segment 23. The anchoring bushing 36 may be substantially equal in diameter to the inside diameter of the lower segment 23 to maintain a tight fit against the inside wall of the lower segment 23. The anchoring bushing 36 may be securely fixed in place with an anchor screw 31 or other means known in the art. The lower end of a rigid rod 38 may be tightly secured within a central bore in the bushing 36. The rigid rod 38 may be somewhat shorter than the lower segment 23 so that its upper end 39 may lie several inches below the upper edge of the lower segment 23. The upper end 39 of the rigid rod 38 may be tapered or rounded.

Figure 4:
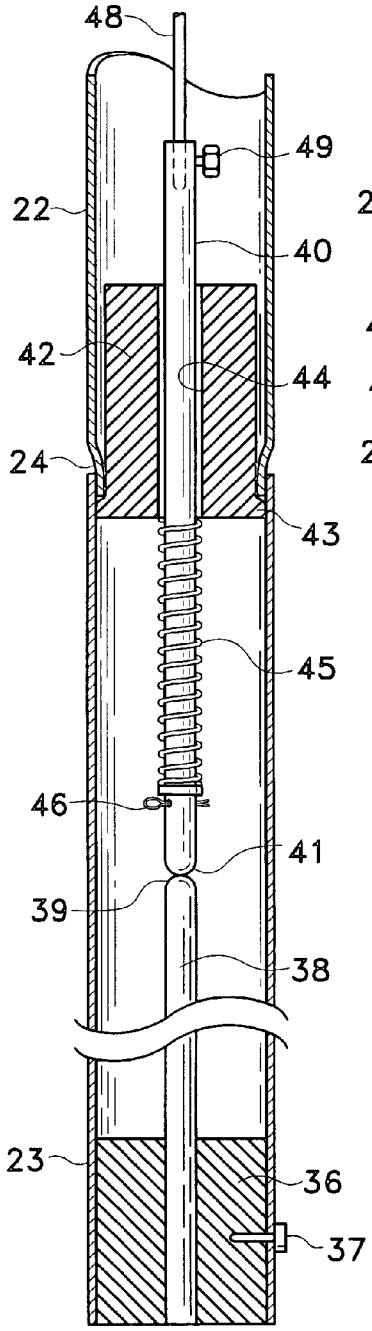
FIG. 4 is a sectional view of the plunger mechanism engaged.
Figure 5:
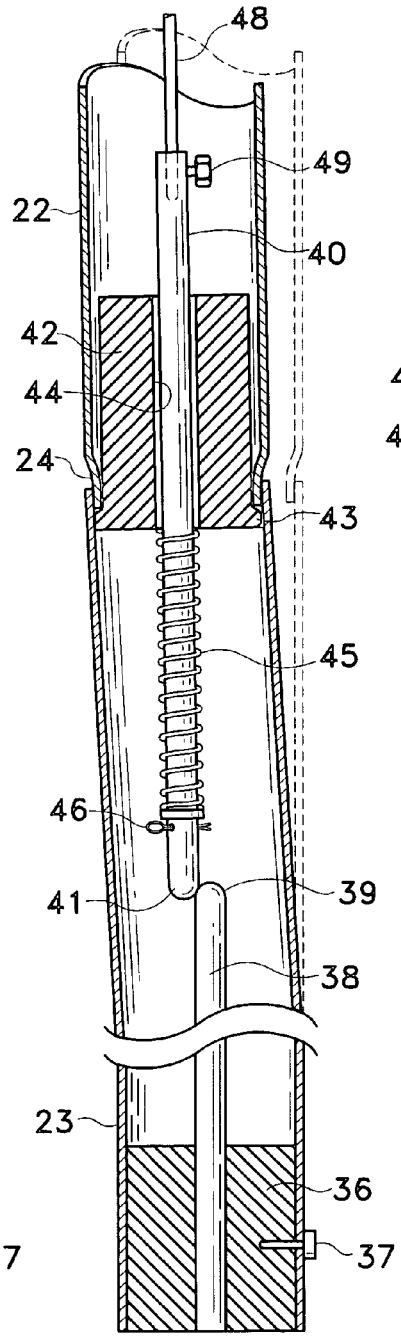
FIG. 5 is a sectional view of plunger mechanism disengaged.

A plunger 40 disposed in the upper segment 22 of the support post 21 may articulate with and rest upon the tapered end 39 of the rigid rod 38. The lower end 41 of the plunger 40 may also be tapered or rounded so that there may be minimal surface contact between the lower end 41 of the plunger 40 and upper end 39 of the rigid rod 38. The plunger 40 may also be of rigid construction and may extend from the point of contact with the rigid rod 38 upward into the upper segment 22. There may be a second bushing 42 located at the bottom of the upper segment 22. The outer diameter of this bushing 42 may be only slightly smaller than the internal diameter of the upper segment 22 so that it may fit snugly within the bottom of the upper segment 22. There may be a circular flange 43 about the bottom of the second bushing 42 that extends outward beyond its bottom edge and beyond the bottom edge of the upper segment 22. This flange 43 may prevent the bushing 43 from sliding up into the upper segment 22. See FIGS. 4 and 5.

Figure 6:
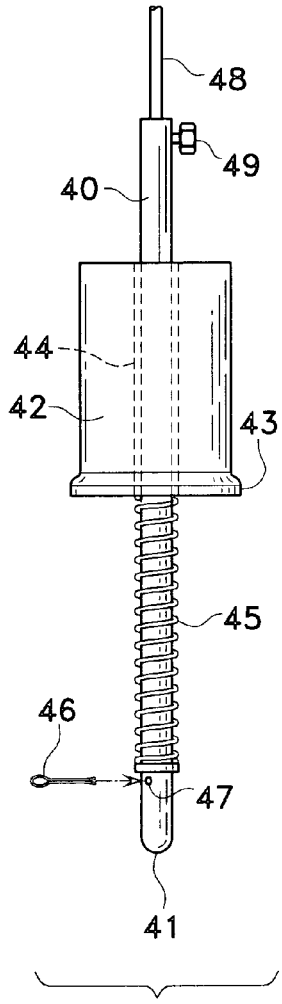
FIG. 6 is a perspective view of the plunger assembly.

The plunger 40 may be disposed within a central vertical bore 44 through the second bushing 42 and may extend downwardly therefrom. The bore 44 may be sufficiently larger than the diameter of the plunger 40 to the extent that the plunger 40 may move freely, vertically only, within the bore 44. There may be a compression spring 45 about the lower portion of the plunger 40 beneath the second bushing 42 which may be held in place by a clip 46 that passes through an opening 47 in the plunger 40. The compression spring 45 may maintain downward pressure on the plunger 40 to aid in its moving downward when the support post 21 flexes, and also may provide upward pressure against the bushing 43 to prevent it from sliding down into the lower segment 23. The upper portion of the plunger 40 may extend above the second bushing 42. There may be a short vertical bore in the upper end of the plunger 40 into which an actuator rod 48 may be fixedly inserted and maintained within the bore 44 with a mounting screw 49. These structures may be seen in FIGS. 4, 5 and 6.

The essential actuating mechanism of the present invention may be the movable spring loaded plunger 40 resting on the rigid rod 38 immovably secured at the bottom of the lower segment 23 of the support post 21. The umbrella 20 of the present invention may close automatically when acted upon by high winds. However, it may not be the action of the wind on the canopy 27 per se that causes the umbrella 20 to close. When high winds are directed against the open umbrella 20, the support post 21 may be caused to sway or flex in the wind. As noted above, the tapered end 41 of the plunger 40 rests on the tapered end 39 of the rigid rod 38. When the support post 21 flexes in the wind the post 21 may veer from the vertical enough to cause the plunger 40 to be displaced downwardly from its perch on the rigid rod 38. This downward displacement of the plunger 40 may carry with it the communicating actuator rod 48 which may also move downwardly thereby actuating the closing mechanism. See FIGS. 4 and 5.

Figure 7:
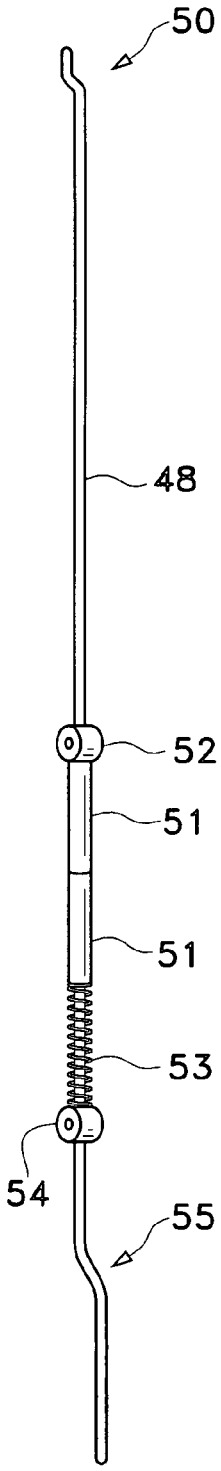
FIG. 7 is a perspective view of the actuator rod.
Figure 8:
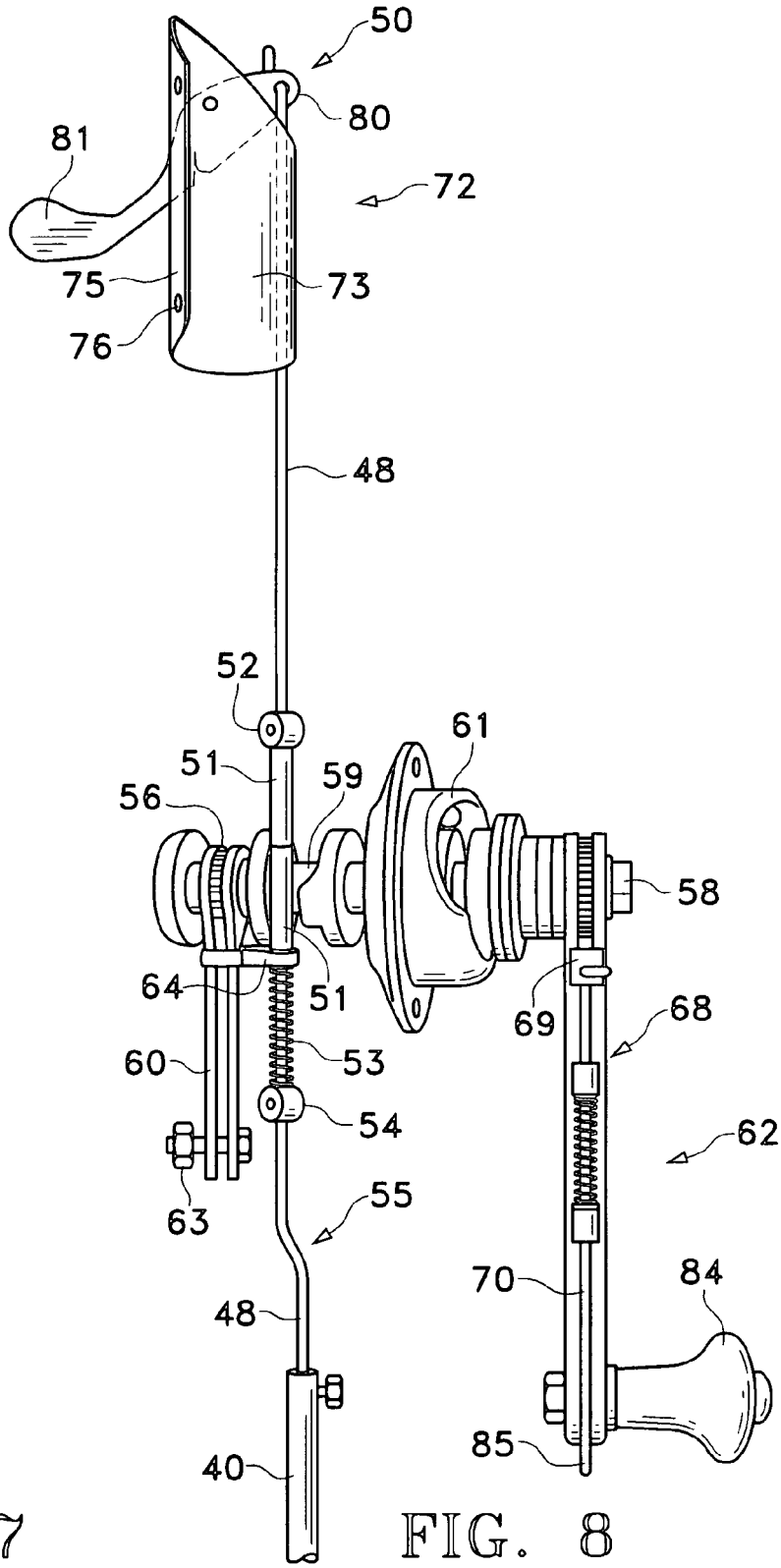
FIG. 8 is a perspective view of the actuator rod, shaft assembly and reset lever assembly.

The actuator rod 48 may be a solid metal rod of smaller diameter than the plunger 40 and may extend from its connection to the plunger 40 upward within the support post 21 to a reset lever 80 situated in the upper segment 22. There may be two bend areas in the actuator rod 48, a first bend system 55 near the lower end to enable proper alignment of the actuator rod 48 for cooperation with a cable release mechanism, and a second bend or Z-bend 50 near the upper end to cooperate with and activate the reset lever 80. Situated about the actuator rod 48 there may be a compression ratchet spring 53 the tension of which may be maintained by two keepers, a first keeper 52 above the ratchet spring 53 and a second keeper 54 below the ratchet spring 53. The actuator rod 48 may be in close proximity to the windings of a flexible cable 65 that may lift and hold the canopy 27 in opened orientation. To insure that the first keeper 52 does not become caught in the cable 65 two spacers 51 may be interposed between the ratchet spring 53 and the first keeper 52. These structures may be seen in FIGS. 7 and 8.

Figure 9:
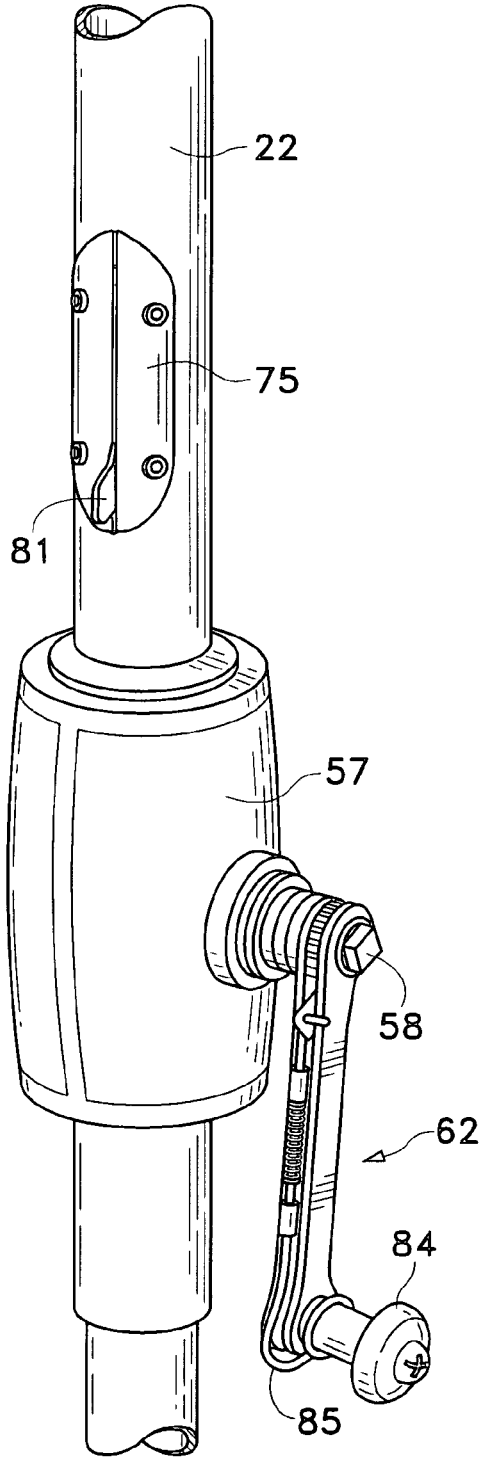
FIG. 9 is a perspective view of the upper segment of the support post with reset lever assembly and hand crank assembly.

The activation of the closing mechanism may also depend upon a horizontal shaft 58, substantially square in cross-section, which may be rotatably mounted within the upper segment 22 of the support post 21. The shaft 58 may be held in place through the upper segment 22 wall by means of a cotter pin 67 or other known fastening means. There may be a winding spool 59 in the central portion of the shaft 58. One end of the shaft 58 may pass through the ratchet wheel 56 of a releasing ratchet. An anchor bolt 63 may mount the releasing ratchet frame 60 to the wall of the upper segment 22 which may enable the releasing ratchet to act as a support for one end of the shaft 58. The second end of the shaft 58 may pass through a bearing 61 affixed to the opposite wall of the upper segment 22. The bearing 61 may support the second end of the shaft 58 and promote smooth rotation of the shaft 58. The entire shaft assembly may be enclosed within a housing 57 with only a hand crank assembly 62 which articulates with the second end of the shaft 58 being visible outside the housing 57. (See FIG. 9)

Figure 14:
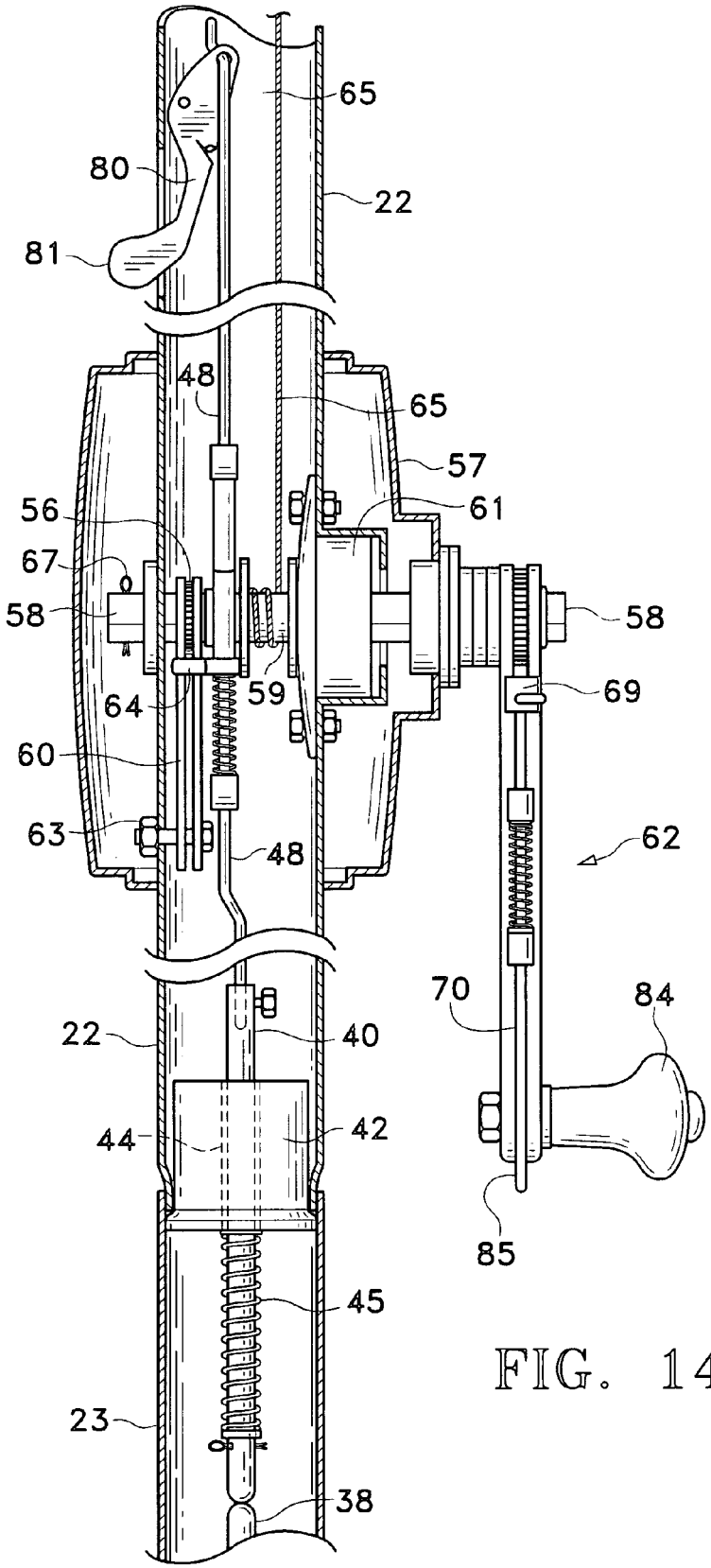
FIG. 14 is a sectional view of the umbrella closing systems.

The releasing ratchet 60 may have a pawl or ratchet lever 64 which may have an angled extension with an opening through which the actuator rod 48 may pass. The opening in the extension of the ratchet lever 64 may place the extension along the actuator rod 48 at a point below the spacers 51 and above the ratchet spring 53. (FIGS. 8 and 14) The two keepers 52 and 54 may maintain tension on the ratchet spring 53 which in turn may assist in keeping the ratchet lever 64 in elastic contact with the ratchet wheel 56. Without the presence of the ratchet spring 53 there may be premature wearing of the cooperating ratchet parts when the shaft 58 rotates.

One end of the flexible cable 65 may be attached to the winding spool 59 by being passed through an opening in the spool 59 and secured with a crimped ferrule or by any other means known in the art. The cable 65 may extend upwardly through the upper segment 22 and pass out of the upper segment 22 over a pulley 66 which may be rotatably affixed into an opening in the wall of the upper segment 22. The pulley 66 may be seen in FIG. 2. The cable 65 may thereafter be directed downward along the exterior wall of the upper segment 22 and may be secured to the slidable sleeve 31 situated around the upper segment 22. When the cable 65 is wound onto the spool 59 the slidable sleeve 31 may be raised to its highest point and the canopy 27 of the umbrella 20 may be fully opened. At the same time the shaft 58 may be prevented from free rotation by the cooperation of the ratchet lever 64 with the ratchet wheel 56 of the releasing ratchet to maintain the umbrella 20 in opened orientation. When the umbrella 20 closes, the ratchet lever 64 may disengage from the ratchet wheel 56 allowing the shaft to rotate rapidly and thereby letting the cable 65 play out.

Figure 10:
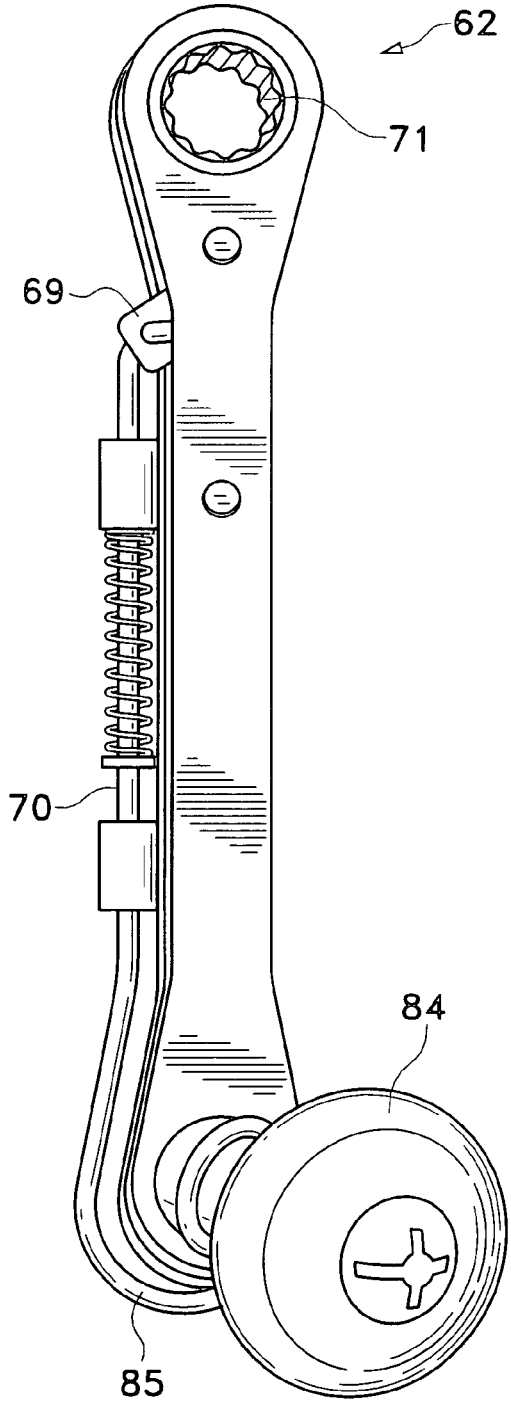
FIG. 10 is a perspective view of the hand crank assembly.
Figure 11:
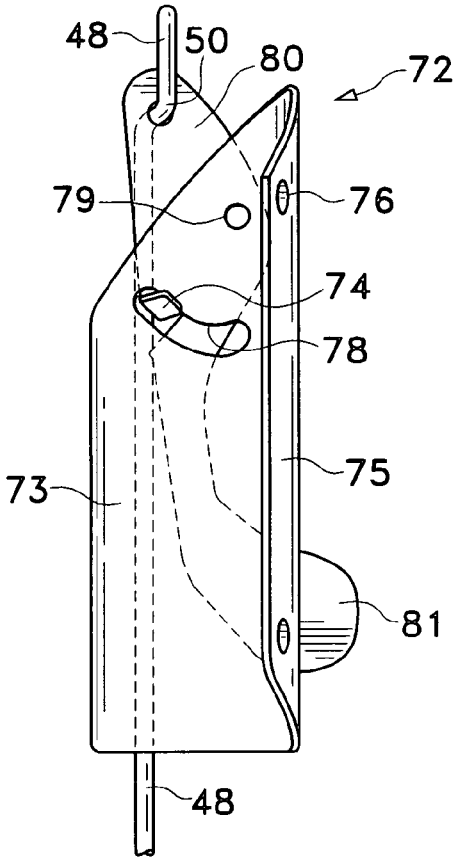
FIG. 11 is a perspective view of the reset lever assembly.
Figure 12:
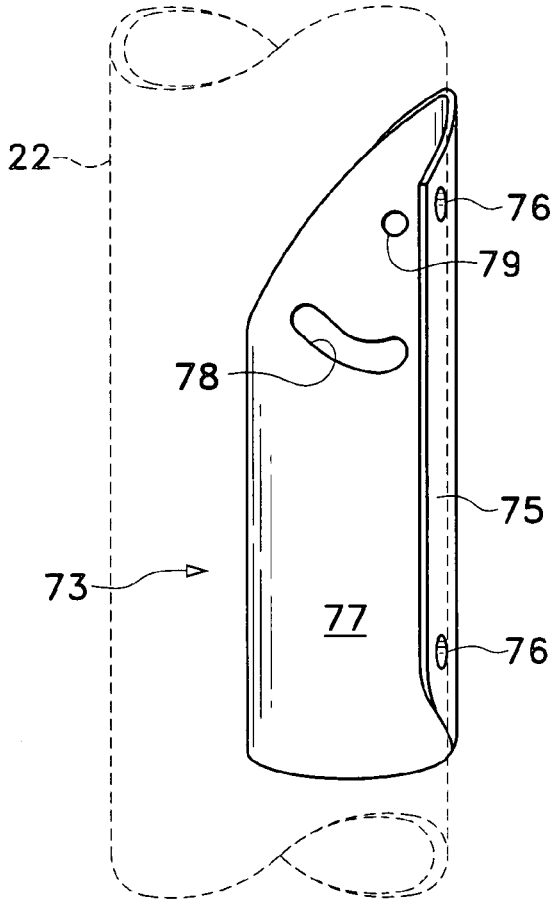
FIG. 12 is a side view of the reset lever assembly bracket.
Figure 13:
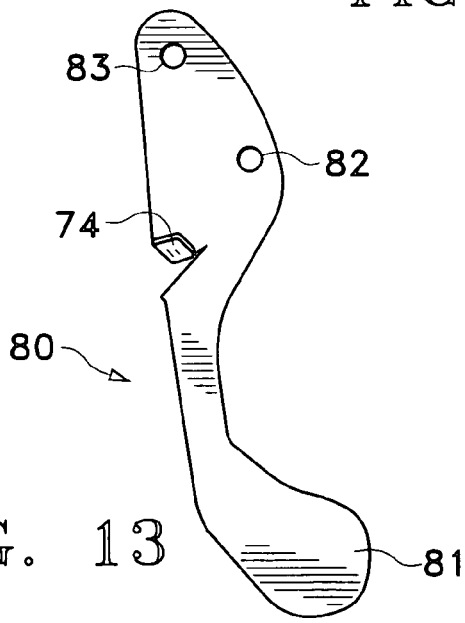
FIG. 13 is a side view of the reset lever.

The hand crank assembly 62 attached to the second end of the shaft 58 may be caused to rotate rapidly with the shaft 58 when the shaft 58 rotates. To prevent injury to anyone who may be nearby, a second ratchet assembly 68 may be a part of the hand crank assembly 62. In this ratchet assembly 68 the pawl or ratchet lever 69 may not be engaged with the ratchet wheel 71 which may surround the shaft 58 so that the hand crank assembly 62 may not rotate when the shaft 58 rotates. To engage the ratchet lever 69 with the ratchet wheel 71 when the umbrella 20 is to be opened manually, there may be a spring loaded rod 70 attached to the ratchet lever 69 and disposed along the ratchet frame and down around a crank knob 84 located at the bottom of the ratchet frame. The lower part of the rod 70 may wrap around the crank knob 84 forming a trigger 85. The ratchet lever 70 may be raised by pressing the trigger 85 against the crank knob 84 when the knob 84 is to be rotated. This may cause the ratchet lever 70 to engage the ratchet wheel and thereby the shaft 58 which may be rotated as the crank knob 84 is rotated. When the shaft 58 is rotated, the cable 65 may be wound onto the winding spool 59 and the canopy 27 opened. At all other times the hand crank assembly 62 may float independently. (See FIGS. 8, 10 and 14)

As previously discussed, when the support post 21 is acted upon by high winds it may be caused to flex which may cause the plunger 40 to slip off the rigid rod 38 activating the releasing ratchet 60 so the cable 65 may be let out and the umbrella canopy 27 may close. It may be necessary to have a restraint on the extent of downward movement for the plunger 40. If it moves down too far it may become wedged between the rigid rod 38 and the wall of lower segment 23 of the support post 21. Additionally, once the plunger 40 may be displaced from the rigid rod 38 it may hang freely and put stress on the actuator rod 48 and connected parts. To prevent this occurrence, a reset assembly 72 may be utilized. The reset assembly 72 may be mounted within the upper segment 22 of the support post 21 above the housing 57.

The reset assembly 72 may consist of a bracket 73 and a reset lever 80. The bracket 73 may be mounted within an opening in the wall of the upper segment 22. The bracket 73 may be substantially cylindrical and may have two outward flanges 75 that may be curved to fit closely against the outer wall of the upper segment 22. There may be openings 76 in the flanges for rivets or other means to secure the bracket 73 to the outer wall. The cylindrical body 77 of the bracket 73 may be situated within the upper segment 22. There may be a slot 78 in the body 77 of the bracket 73 and openings 79 through which to secure a pivot pin (not illustrated).

The reset lever 80 may be in the nature of a plate having a rounded extension tab 81 at the bottom, a pivot aperture 82 through which the pivot pin may pass, an articulating opening 83 at the top and a stop tab 74 that may be at a substantially right angle to the plate. The reset lever 80 may be set into the bracket 73 by means of the pivot pin which may permit pivotal movement to the reset lever 80. The stop tab 74 may be disposed within the slot 78 in the bracket 73 in such a manner that the stop tab 74 can move along the slot 78 but not out of the slot 78 when the reset lever 80 pivots. The reset lever 80 may lie within the bracket 73 except for a very small portion of the extension tab 81 which may protrude from the bracket 73 and the upper end of the reset lever 80 which may extend above the bracket 73. The upper end of the actuator rod 48 also extends above the bracket 73 and the end of the actuator rod 48 by means of the Z-bend 50 may pass through the articulating opening 83 in the reset lever 80. Thus the reset lever 80, by means of the actuator rod 48 may be connected to the plunger 40. When the plunger 40 may be displaced from the rigid rod 38 and move downwardly, the actuator rod 48 may also be moved downwardly exerting a downward force on the reset lever 80. The reset lever 80 may then pivot so that the entire extension tab 81 extends outward from the bracket 73. The reset lever 80 may only pivot to the extent the stop tab 74 can move within the slot 78. This restricted motion may permit the actuator rod 48 to move downward only a small distance and with it the plunger 40 which may be prevented from moving down into the lower segment 23 and becoming wedged against the wall by the stop tab 74 of the reset lever 80 restrained within the slot 78 of the bracket 73.

As noted above, when the umbrella 20 closes, the slidable sleeve 31 moves downward. When the umbrella may be completely closed the slidable sleeve 31 may be disposed below the reset lever 80 along the upper segment 22 of the support post 21. As the sleeve 31 passes over the reset lever 80 the extension tab 81 may be pressed inward causing the reset lever 80 to pivot inward and upward, thus raising the upper end and with it the actuator rod 48 which in turn may lift the plunger 40 back to its original position to rest on the rigid rod 38. The time from actuation to reset may be the time it takes for the sleeve 31 to slide down the support post 21 to close the umbrella 20, a matter of seconds. Once the sleeve 31 passes over the reset lever 80 the plunger 40 may be returned to its starting position. Thus the plunger 40 does not remain suspended for more than several seconds and all parts depending from and attached to the actuator rod 48 (which is attached to the plunger 40) may be returned to their starting positions.

In operation, the wind on the open umbrella 20 causes the support post 21 to sway and flex; the flexing motion causes the plunger 40 to slip downward off the rigid rod 38; the actuator rod moves downward with the plunger 40 and moves the ratchet lever 64 away from the ratchet wheel 56 permitting the shaft 58 to rotate freely; the unrestrained cable 65 begins to unwind; the pressure of the hydraulic piston 33 on the attached rib causes it to begin to pivot downward; the primary ribs 28 and secondary ribs 29 pivot downward and inward until the piston 33 is fully extended and the ribs are parallel to the support post 21; the hydraulic cylinder 32 prevents the canopy 27 from reopening even in very high winds; at the same time, the slidable sleeve 31 to which the secondary ribs 29 are attached moves downward and passes over the reset lever 80 pressing the extension tab 81 inward and pivoting the reset lever 80 upward, raising the actuator rod 48 and with it, returning the plunger 40 to its original place atop the rigid rod 38. The umbrella 20 may remain closed until the user grasps the hand crank 62, depresses the trigger 85, and winds hand crank knob 84 which in turn winds the cable 65 onto the winding spool 59 raising the slidable sleeve 31 and opening the canopy 27. The shaft 58 being fully engaged by the releasing ratchet 60 cannot rotate freely and so may hold the wound cable 65 securely and the umbrella in open orientation.

The umbrella may be closed manually by exerting lateral pressure on the pole to deflect it from the vertical. Any lateral pressure on the pole may cause the plunger to be displaced and the closing mechanism to be activated.

Since all parts of the umbrella assembly and closing mechanism bear considerable weight and are at times under mechanical stress it is advisable that they be manufactured of metal. The winding cable must also be of good quality so that it does not fray. Though the ribs supporting the canopy may be hollow, the single rib to which the hydraulic cylinder is attached should be solid or otherwise reinforced to withstand the constant pressure of the loaded piston.

While one embodiment of the present invention has been illustrated and described in detail, it is to be understood that this invention is not limited thereto and may be otherwise practiced within the scope of the following claims.

I claim:

1. An outdoor umbrella that closes automatically when acted upon by high winds, said umbrella comprising:

(a) a canopy, a canopy support including a fixed collar and pivotally attached primary ribs in cooperation with secondary ribs each secondary rib being pivotally attached at one end to a primary rib and at the other end to a slidable sleeve disposed beneath the collar, a pulley situated above the slidable sleeve, a rotatable horizontal shaft having a first end and a second end situated below the slidable sleeve, a flexible cable a first end of which is affixed to the horizontal shaft and the second end extending upward over the pulley and being affixed to the slidable sleeve, a crank assembly in cooperation with the second end of the horizontal shaft and a support base for supporting the umbrella on a horizontal surface;

(b) a main tubular support post divided into two segments, an upper first segment in communication with a lower second segment, each segment having an upper end, a midpoint, and a lower end, the fixed collar being affixed to the upper end of the first segment, the slidable sleeve receiving said first segment and being slidable thereon, the pulley being mounted within said first segment between the collar and the slidable sleeve, an opening in a wall of said first segment adjacent said pulley such that the second end of the flexible cable exits the first segment through said opening to reach said slidable sleeve and said horizontal shaft being rotatably mounted at substantially the midpoint of the first segment and extending outward through opposing walls thereof, said two segments enabling the assembly and maintenance of the contained structures;

(c) an expansile member for the exertion of constant pressure on a secondary rib to close the canopy in response to the high winds and for preventing the canopy from reopening in the high winds;

(d) a first support assembly supporting one end of the horizontal shaft including means for restricting the free rotation of the horizontal shaft until the umbrella is acted upon by the high winds, and a second support assembly supporting the opposing end of the horizontal shaft and permitting smooth rotation of the horizontal shaft when the umbrella closes in response to the high winds;

(e) means for preventing the crank assembly from rotating as the horizontal shaft rotates when the umbrella is acted upon by the high winds;

(f) a trigger assembly in communication with the restricting means to release the restricting means when the umbrella is acted upon by the high winds permitting the horizontal shaft to rotate freely; and (g) a reset system to automatically reset the trigger assembly as the umbrella closes in response to the high winds.

2. An outdoor umbrella that closes automatically when acted upon by high winds, said umbrella comprising:

(a) a canopy, a canopy support including a fixed collar and pivotally attached primary ribs in cooperation with secondary ribs each secondary rib being pivotally attached at one end to a primary rib and at the other end to a slidable sleeve disposed beneath the collar, a pulley situated above the slidable sleeve, a rotatable horizontal shaft having a first end and a second end situated below the slidable sleeve, a flexible cable a first end of which is affixed to the horizontal shaft and the second end extending upward over the pulley and being affixed to the slidable sleeve, a crank assembly in cooperation with the second end of the horizontal shaft and a support base for supporting the umbrella on a horizontal surface;

(b) a main tubular support post divided into two segments, an upper first segment in communication with a lower second segment, each segment having an upper end, a midpoint, and a lower end, the fixed collar being affixed to the upper end of the first segment, the slidable sleeve receiving said first segment and being slidable thereon, the pulley being mounted within said first segment between the collar and the slidable sleeve, an opening in a wall of said first segment adjacent said pulley such that the second end of the flexible cable exits the first segment through said opening to reach said slidable sleeve and said horizontal shaft being rotatably mounted at substantially the midpoint of the first segment and extending outward through opposing walls thereof, said two segments enabling the assembly and maintenance of the contained structures;

(c) means for exerting constant pressure on a secondary rib to close the canopy in response to the high winds and for preventing the canopy from reopening in the high winds;

(d) a releasable first ratchet assembly supporting the first end of the horizontal shaft and restricting the free rotation of the horizontal shaft until the umbrella is acted upon by the high winds;

(e) a second ratchet assembly to prevent the crank assembly from rotating as the horizontal shaft rotates when the umbrella is acted upon by the high winds;

(f) a trigger assembly to actuate the releasable first ratchet assembly; and (g) means for automatically resetting the trigger assembly as the umbrella closes in response to the high winds.

3. An outdoor umbrella as described in claim 2 wherein the means for exerting constant pressure on a secondary rib to close the canopy in response to high winds and for preventing the canopy from reopening in the high winds comprises:

an expansile member having a first end and a second end, said first end being pivotally attached to the first segment of the support post beneath the collar, and said second end being pivotally attached to a substantially midpoint of a secondary rib, said expansile member exerting constant downward pressure on the secondary rib;

whereby when the umbrella is acted upon by the high winds the first ratchet assembly is actuated permitting the horizontal shaft to rotate freely, the constant pressure of the expansile member on the secondary rib causes said rib to pivot downwardly which in turn causes the other secondary ribs and the primary ribs to pivot downwardly until the primary and secondary ribs are substantially parallel to the main support post thereby closing the canopy, said constant downward pressure of the expansile member on the secondary rib preventing the canopy from reopening.

4. An outdoor umbrella as described in claim 3 further comprising a reinforced secondary rib and wherein said expansile member being in the form of a loaded hydraulic cylinder such that the cylinder is pivotally attached to the first segment of the support post beneath the collar and the piston is pivotally attached to the substantially midpoint of the reinforced secondary rib.

5. An outdoor umbrella as described in claim 2 wherein the releasable ratchet assembly comprises:

a frame, affixed to the wall of the first segment of the support post, through which the first end of the horizontal shaft extends and is thereby supported, a ratchet wheel disposed within the frame and surrounding the horizontal shaft, and a ratchet lever, said ratchet lever having a horizontal extension with a vertical opening therethrough;

whereby when the ratchet lever engages the ratchet wheel the horizontal shaft is restricted from rotating and when the ratchet lever is disengaged from the ratchet wheel the horizontal shaft can rotate freely.

6. An outdoor umbrella as described in claim 5 wherein the horizontal shaft is polygonal in cross section for cooperation with the releasable ratchet assembly, said polygon having at least four sides.

7. An outdoor umbrella as described in claim 6 further comprising a bearing affixed to the wall of the first segment opposite the frame through which the second end of the horizontal shaft extends and is thereby supported, said bearing for smooth rotation of the horizontal shaft.

8. An outdoor umbrella as described in claim 7 further comprising a housing surrounding the substantial midpoint of the first segment of the support post, said housing containing the horizontal shaft, the releasable first ratchet assembly and the bearing; said crank assembly disposed on the second end of the horizontal shaft being situated without the housing.

9. An outdoor umbrella as described in claim 5 wherein the trigger assembly comprises:

a rigid rod having an upper end and a lower end, said lower end being permanently anchored in the lower end of the second segment of the support post, the upper end of the rigid rod being tapered and located below the upper end of the second segment;

means for anchoring the lower end of the rigid rod in the lower end of the second segment;

a plunger having an upper end and a lower end, said lower end being tapered and in weight bearing cooperation with the tapered upper end of the rigid rod, the upper end of the plunger extending upward into the first segment of the support post;

means for centering the plunger over the rigid rod; and an actuator rod having an uppermost end, a substantially mid point and a lowermost end, the lowermost end of said actuator rod in fixed communication with the upper end of the plunger, the substantially mid point of the actuator rod disposed through the opening in the horizontal extension of the ratchet lever of the releasing ratchet for cooperation with said ratchet lever, and the uppermost end of the actuator rod extending upward within the first segment to communicate with the reset means;

whereby when the umbrella is acted upon by high winds the main tubular support post is caused to flex and said flexing movement causes the plunger, and with it the actuator rod, to be displaced downwardly from the rigid rod and as the actuator rod moves downward it causes the ratchet lever of the releasable ratchet assembly to become disengaged from the ratchet wheel which in turn allows the horizontal shaft to rotate freely, the flexible cable to unwind, and the constant downward pressure of the expansile member on the reinforced secondary rib to close the canopy.

10. An outdoor umbrella as described in claim 9 wherein the means for anchoring the lower end of the rigid rod comprises:

a bushing disposed at the lower end of the second segment of the support post, being dimensioned to fit tightly within the second segment, and having a central vertical bore into which the lower end of the rigid rod is permanently situated and axially centered within the second segment.

11. An outdoor umbrella as described in claim 9 wherein the means for centering the plunger over the rigid rod comprises:

a bushing disposed at the lower end of the first segment of the support post, said bushing having about its lower edge means for preventing the bushing from sliding upward into the first segment;

a central vertical bore in the bushing dimensioned to have the plunger slidingly disposed therethrough; and means for maintaining downward pressure on the plunger.

12. An outdoor umbrella as described in claim 11 wherein the means for maintaining downward pressure on the plunger comprises:

a compression spring disposed beneath the bushing and surrounding the plunger and means for holding the compression spring in place.

13. An outdoor umbrella as described in claim 9 wherein the actuator rod further comprises:

means for aligning the actuator rod with respect to the horizontal shaft and the opening in the horizontal extension of the ratchet lever of the releasable ratchet assembly;

means, disposed at the upper end of the actuator rod, for communicating with the reset means; and means for biasing the ratchet lever of the releasable ratchet assembly to lessen the wear of the ratchet lever against the ratchet wheel.

14. An outdoor umbrella as described in claim 13 wherein the means for aligning the actuator rod comprises:

at least one bend in the actuator rod at a point below the horizontal extension of the ratchet lever such that the portion of the actuator rod in communication with the horizontal extension of the ratchet lever is in vertical orientation.

15. An outdoor umbrella as described in claim 13 wherein the means for biasing the ratchet lever comprises an activating spring disposed about the actuator rod below the horizontal extension of the ratchet lever, a first keeper below the spring and a second keeper above the horizontal extension of the ratchet lever.

16. An outdoor umbrella as described in claim 15 further comprising at least one spacer interposed between the second keeper and the horizontal extension of the ratchet lever to raise the second keeper out of the way of the flexible cable.

17. An outdoor umbrella as described in claim 9 wherein the means for automatically resetting the trigger assembly as the umbrella closes in response to the high winds comprises:

a bracket permanently disposed within the first segment of the support post at a point that is below the slidable sleeve when the canopy is in open orientation, a vertical opening in the bracket contiguous with an opening in the wall of the first segment of the support post, means on opposing sides of the bracket for accepting a pivot pin, and a restraining slot in a side of the bracket; and a reset lever substantially in the form of a plate having an upper portion, a central portion and a lower portion, means in the upper portion for cooperating with the uppermost end of the actuator rod, a pivot aperture, a stop tab in substantially the central portion, said stop tab being substantially at a right angle to the plate for slidable communication within the restraining slot in the bracket, and a reset tab in the lower portion contained within the bracket and pivotally extending outward of the bracket through the vertical opening when the reset lever is activated;

whereby when the actuator rod is downwardly displaced the reset lever is pivoted to the extent that the stop tab is restrained within the restraining slot to restrict the extent of the downward displacement of the actuator rod and prevent the plunger from falling into the lower segment of the support post, the reset tab extends outward through the vertical opening in the bracket, and as the canopy closes and the slidable sleeve moves downward on the upper segment of the support post and passes over the reset tab pushing the reset tab back into the bracket, thereby pivoting the reset lever upward, raising the actuator rod, and causing the plunger to be reseated on the rigid rod.

18. An outdoor umbrella as described in claim 17 further comprising a Z-bend at the uppermost end of the actuator rod for cooperation with the upper portion of the reset lever.

19. An outdoor umbrella as described in claim 2 wherein the second ratchet assembly comprises:

a ratchet situated without the first segment of the support post and mounted on the second end of the horizontal shaft, said ratchet comprising a frame, a ratchet wheel surrounding the horizontal shaft and a ratchet lever;

a winding knob disposed at the lower end of the frame;

a spring loaded rod in cooperation with the ratchet lever and extending downward and around the winding knob, said spring loaded rod biasing the ratchet lever away from the ratchet wheel;

whereby the ratchet frame depends downward from the second end of the horizontal shaft and does not rotate when the shaft rotates, and when the spring loaded rod is pushed upward at the same time the winding knob is manually rotated the ratchet lever is caused to engage the ratchet wheel and the horizontal shaft is rotated thereby winding the cable onto the horizontal shaft.

* * * * *